US005352173A

United States Patent [19]

McLaughlin

[11] Patent Number: 5,352,173

[45] Date of Patent: Oct. 4, 1994

[54] METHOD FOR EXERCISING BUTTOCK AND THIGH MUSCLES

[76] Inventor: Gary G. McLaughlin, 1300 Wingo St., Arleta, Calif. 91331

[21] Appl. No.: 29,009

[22] Filed: Mar. 10, 1993

[51] Int. Cl.[5] ..... A63B 21/02

[52] U.S. Cl. ..... 482/123; 482/121; 482/133

[58] Field of Search ..... 482/74, 80, 124, 121, 482/148, 128, 91, 133, 135, 136, 140, 141, 142, 907

[56] References Cited

U.S. PATENT DOCUMENTS 1,548,849 8/1925 Ruden ..... 482/128
1,587,749 6/1926 Bierly ..... 482/80
2,494,094 1/1950 Horstman ..... 482/128
3,497,216 2/1970 Feather ..... 482/122
3,497,217 2/1970 Feather ..... 482/122
4,111,416 9/1978 Jinotti ..... 482/80
4,830,345 5/1989 Mar ..... 482/128 X

*Primary Examiner*—Richard J. Apley
*Assistant Examiner*—Jerome Donnelly
*Attorney, Agent, or Firm*—Lawrence S. Cohen

[57] ABSTRACT

Method and apparatus therefor are disclosed for exercising the buttock and thigh muscles. The apparatus (20) has a spring (40) disposed to yieldingly support a seat member (24) between first and second positions 24*a*, 24*b*) above a base 42 as the user urges the seat member between the aforesaid positions.

1 Claim, 5 Drawing Sheets

METHOD FOR EXERCISING BUTTOCK AND THIGH MUSCLES

TECHNICAL FIELD

The present invention relates generally to exercise apparatus and methods and more particularly to apparatus and methods for exercising buttock and thigh muscles.

BACKGROUND ART

U.S. Pats. relating to exercise apparatus include U.S. Pat. Nos. 3,628,791; 3,638,940; 3,741,540; 3,761,081; 4,111,416; 4,804,180; 4,848,742; 4,911,437; 4,583,731; 4,922,892; and 5,071,119. Although some of these patents are directed to resistive spring loaded apparatus none disclose apparatus suitably configured for an exercise in which the hips are urged upwardly by a member and the upward urging can be overcome by a downward muscle action to provide the exercise.

SUMMARY OF THE INVENTION

The present invention is directed to a method for exercising the buttock and thigh muscles.

Apparatus in accordance with the invention are characterized by a spring arranged to yieldingly bias a contact member upwardly to an uppermost position while permitting it to move downwardly when sufficient force is applied.

In accordance with a feature of the invention, the apparatus is dimensioned and arranged to locate the contact member suitably above the apparatus floor abutting surface to facilitate exercise when a user lies with the contact member contacting substantially the area between the buttocks and the lower back.

In a preferred embodiment, the contact member is pivotally mounted from a support vertically spaced above the apparatus floor abutting surface.

In preferred embodiments, a spring is arranged to be respectively either in compression or tension as the contact member is urged downwardly by a user.

In other preferred embodiments, the spring upward force is provided by a blade spring.

In the method, the buttocks and lower back area as specifically selected is placed on the contact member, which is biased upwardly to an initial position, and the user forces the contact member down by muscle action, lowering the body and then lifting the body, the contact member permitted by spring act, ion to rise back to the initial position.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
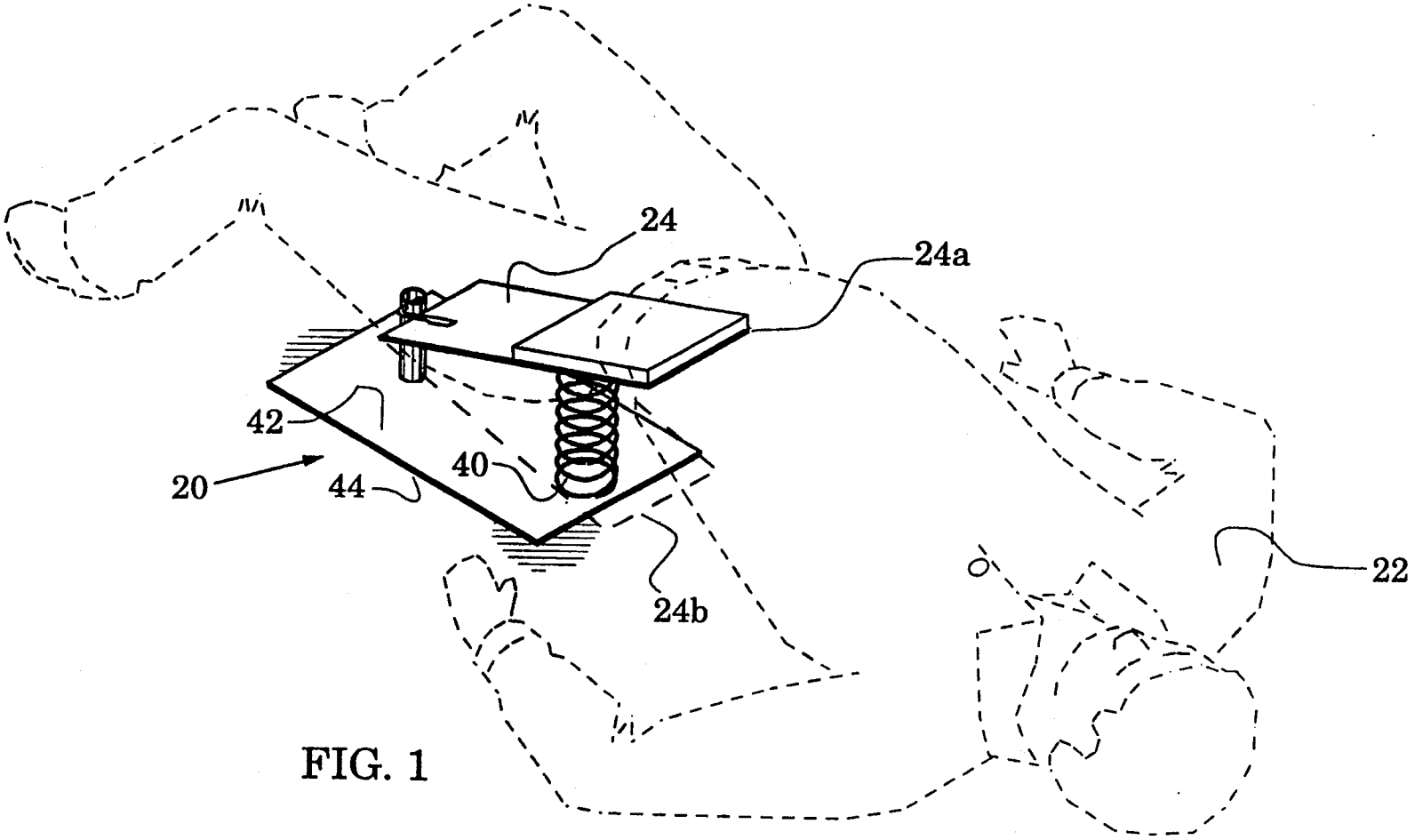
FIG. 1 is a perspective view of the use, in accordance with the present invention, of a preferred buttock and thigh muscle exercise apparatus embodiment.

The present invention is an apparatus for exercising and a method of exercising. In accordance with the invention, a preferred exercise apparatus embodiment 20 is shown in the perspective view of FIG. 1. A user 22 has placed the seat member 24 of the apparatus 20 substantially abutting his lower back and, from this arrangement, may then urge, primarily with his buttock and thigh muscles, the seat member 24 between first and second vertically spaced positions 24*a*, 24*b* thereof against the yielding resistance of a spring 40 disposed between a base 42 and the seat member 24 (the seat member second position 24*b* is indicated by dashed lines). The first position is selected by the user according to the user's size, the amount of upward extension which the user desires to employ, the apparatus dimensions and the amount of distance desired between first and second positions; the second position is similarly selected as the user preforms exercise with the apparatus.

It is apparent in FIG. 1 that the apparatus embodiment 20 is specifically configured for the exercise of these muscles, e.g. the seat member positions 24*a*, 24*b* are vertically spaced convenient distances above the floor abutting surface 44 of the base 42 and the spring 40 is arranged to yieldingly resist the urging of those particular muscles to move the body downwardly. Only an apparatus configured for this intended use will enhance user satisfaction and thus find consistent use.

Figure 2:
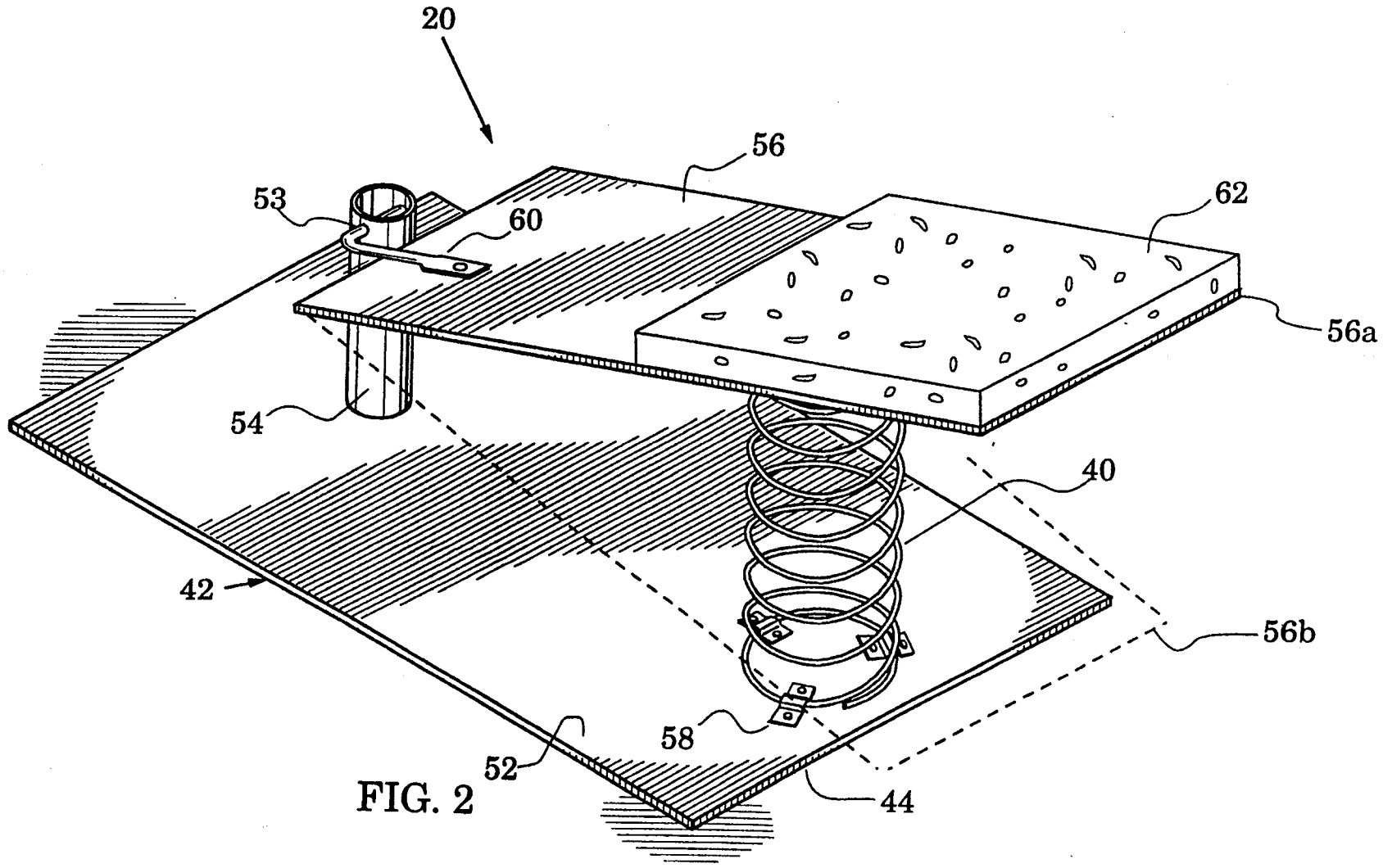
FIG. 2 is an isometric view of the apparatus of FIG. 2.

FIG. 2 illustrates in dot, all the apparatus of FIG. 1 which is seen to have the base 42 defined by a base plate 52 and a post 54 vertically arranged above the base plate. The post 54 forms a support from which the seat member in the form of a scat plate 56 is pivotally mounted at a pivot location vertically spaced above the floor surface 44 of the base 42. The helical spring 40 is mounted between the base plate 52 and the seat plate 56, e.g. with clips 58 at each end of the spring. The pivotal mount is achieved with an L shaped pin 60 secured to the seat plate 56 and inserted through a hole 53 in the post 54 to be secured therein by any means well known in the art, e.g. washer and nut on the pin end. The seat plate 56 may be inclined respectively above and below the pivot hole 53 to seat member positions 56*a*, 56*b* (position 54*b* is indicated by dashed lines). To enhance the comfort of the user 22, a resilient pad 62 is attached to the seat plate 56.

Placement of the spring 40 between the base 42 and seat plate 56 provides a yieldable upward biasing member disposed to support the seat plate between vertically spaced first and second positions. Any manner of pivotal mount may be used such as a hinge. It is important to mount the seat plate so that it will not be free to rock laterally more than a very limited amount.

Figure 3:
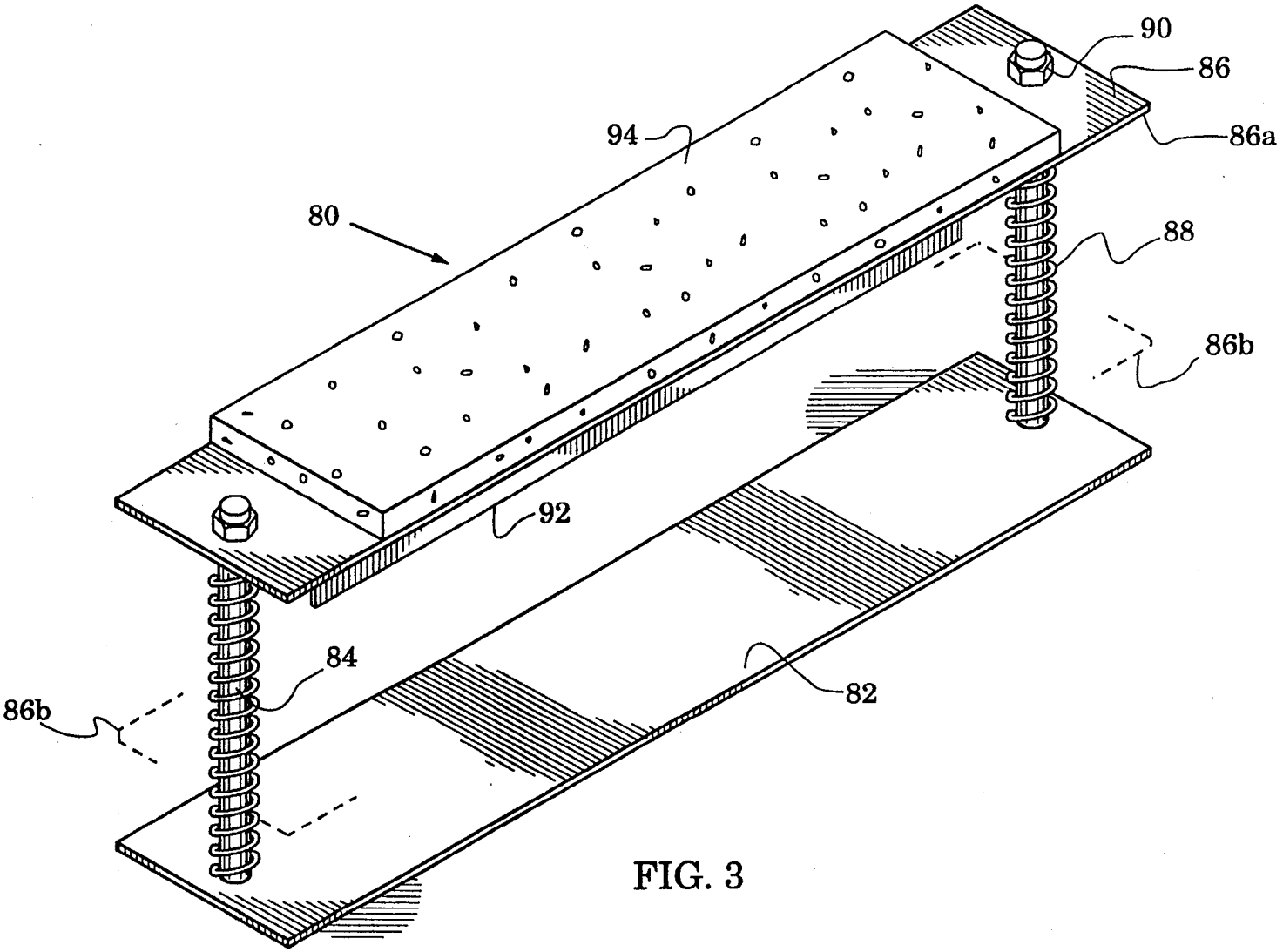
FIG. 3 is an isometric of another preferred apparatus embodiment.

Another preferred apparatus embodiment 80 is shown in the isometric view of FIG. 3. In the embodiment 80, a base is defined by a base plate 82 and a pair of guide elements in the form of posts 84 are vertically oriented from the base plate. A seat plate 86 is slidably received on these guide elements (e.g. by holes defined in the plate) and is yieldingly supported between first and second seat member positions 86*a*, 86*b* (position 86*b* is indicated by dashed lines) by a pair of helical springs 88 disposed over the posts 84. The seat plate 86 is retained on the posts 84 by hardware, e.g. nuts 90. The seat plate 86 is reinforced by a perpendicularly arranged brace 92 and the seat plate carries a resilient pad 94 for comfort of a user of the apparatus. When used in the method illustrated in FIG. 1 the apparatus 80 is arranged transversely beneath the area from the small of the back to the buttocks allowing the user's hips to be located between the posts 84. Placement of the springs 88 between the base 82 and seat plate 86 provides a yieldable upward biasing member disposed to support the seat plate between vertically spaced first and second positions.

Figure 4:
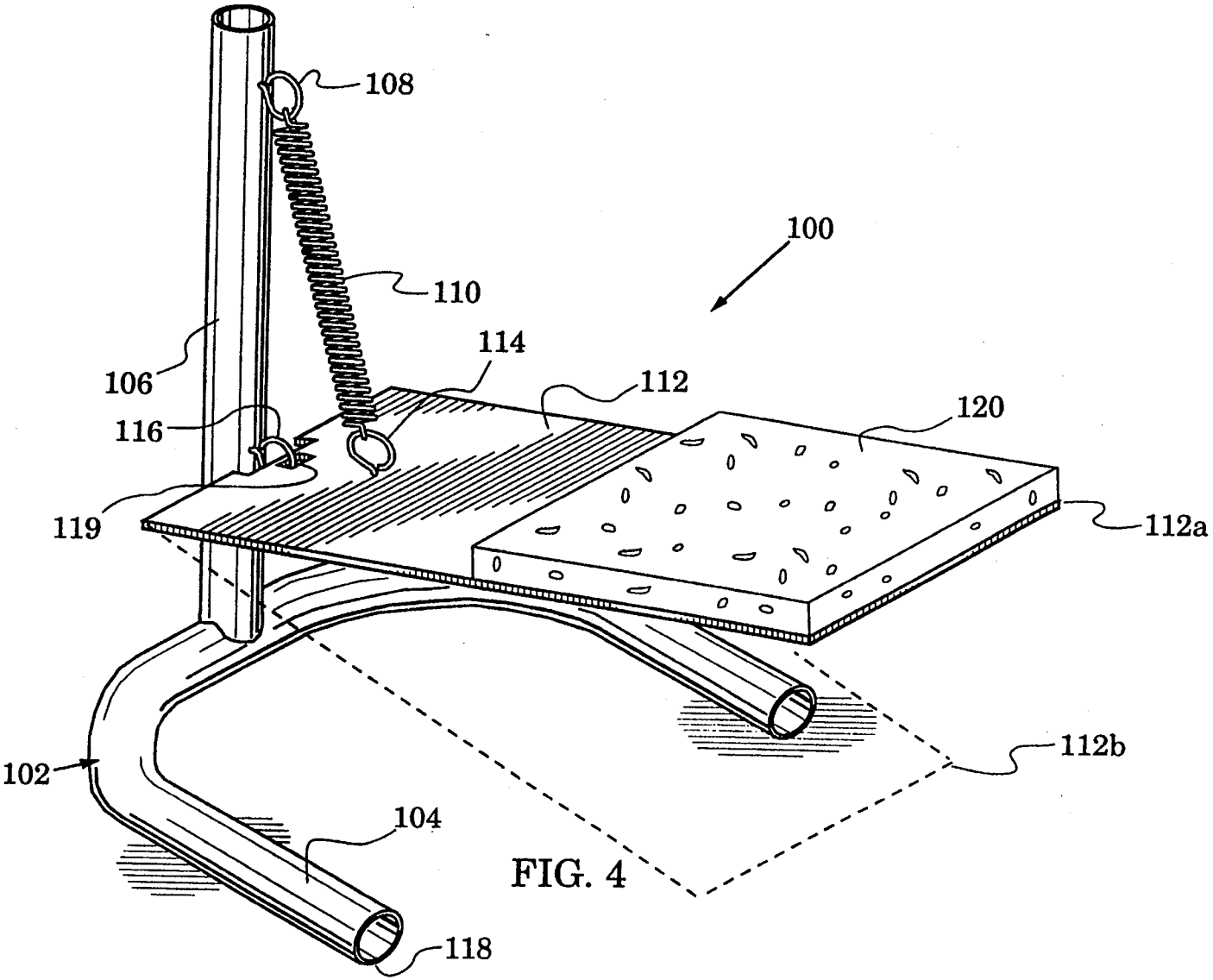
FIG. 4 is an isometric view of another preferred apparatus embodiment.

Another preferred apparatus embodiment 100 is illustrated in the isometric view of FIG. 4. In the embodiment 100 a base 102 is defined by a U shaped tube 104 and a post 106 vertically mounted therefrom (e.g. with brackets or by welding). A support is defined from the tube, e.g. by an eye bolt 108 installed therein, from which a helical spring 110 is disposed between the post 106 and a seat plate 112 (the spring is attached with another eye bolt 114). The seat plate is pivotally attached at a point (defined by eye bolt 116 installed in post 106) vertically spaced from the floor abutting portion 118 of the base 102 by receiving the bolt 116 in an aperture 119.

Thus the seat, plate 112 can yieldingly move between positions 112*a*, 112*b* which are inclined respectively above and below the eye bolt 116. A resilient pad 120 is attached for comfort to the seat plate 112. In the embodiment 100 the spring 110 is arranged to be in tension between first and second seat member positions 112*a*, 112*b* while in embodiments 20 (FIG. 2) and 80 (FIG. 3) the spring (or springs) is arranged to be in compression. Placement of the spring 110 between the base 102 and seat plate 112 provides a yieldable upward biasing member disposed to support the seat plate between vertically spaced first and second positions.

Figure 5:
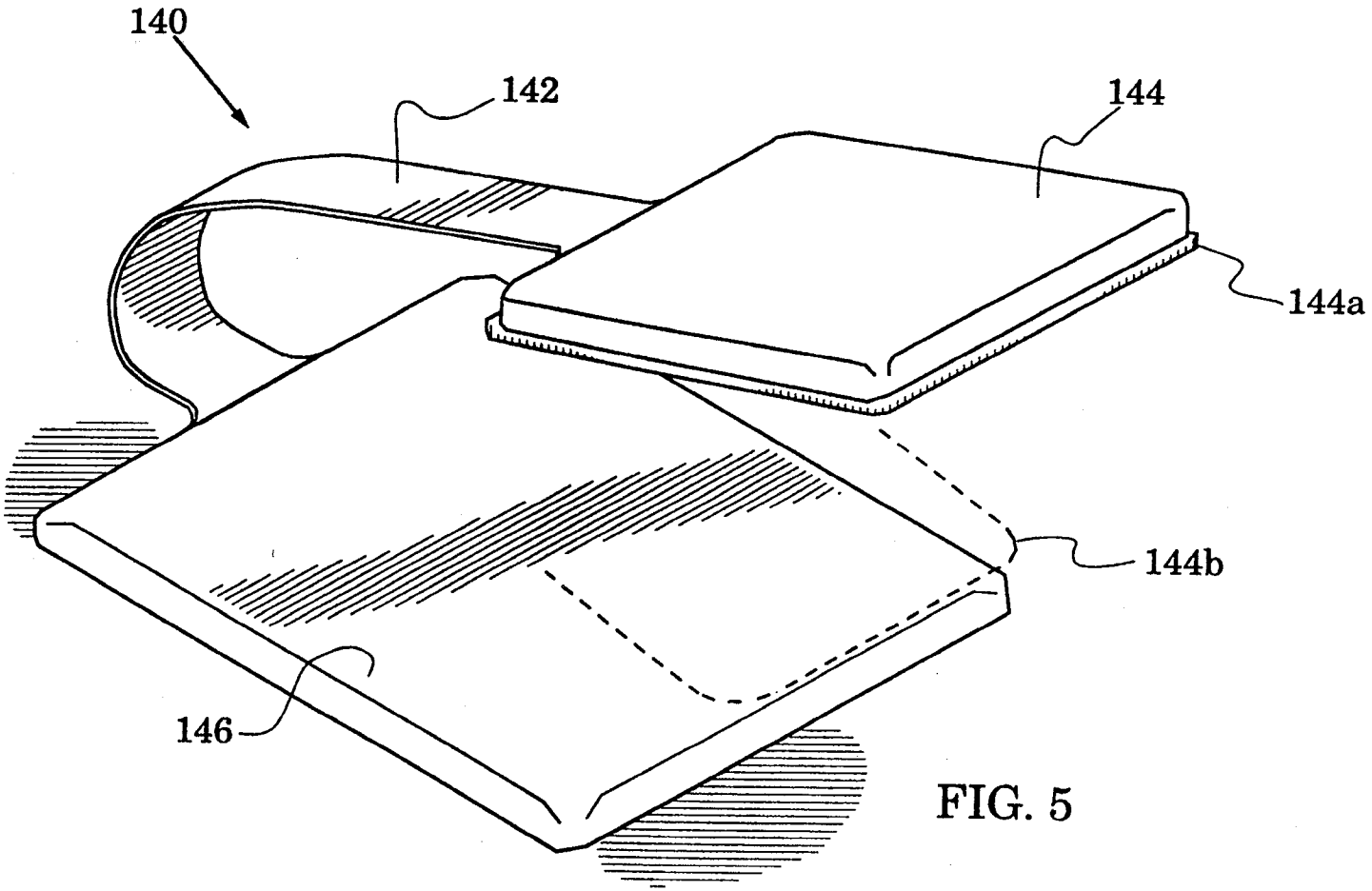
FIG. 5 is an isometric view of another preferred apparatus embodiment.

The isometric view of FIG. 5 illustrates another apparatus embodiment 140 which employs a blade spring 142 to yieldingly support a seat member 144 between first and second vertically spaced positions 144*a*, 144*b*. In this embodiment, placement of the blade spring 142 between the base 146 and seat member 144 provides a yieldable upward biasing member disposed to support the seat member between vertically spaced first and second positions.

From the foregoing it should now be recognized that exercise apparatus embodiments have been disclosed herein especially suited for use in a method of exercising the buttock and thigh muscles. Some parts of the apparatus can be made of metal or plastic.

In the method of the invention, the user's body is positioned on the apparatus, as above described, i.e., in the area between the small of the back and the buttocks. The apparatus provides an upward urging tending to help, along with the user's body muscles, stay in this first position. Then, the user by muscle action will overcome the upward urging by pushing the body downward as far as the user desires to the second position. At that point the spring has increased its restoring force, thereby increasing resistance to downward force, and is tending to urge the body upward against the muscle action pushing downward. The spring is selected to not fully overcome gravity so that some muscle action is required to return to the first position. The exercise cycle of lowering the body and raising the body is repeated a desired number of cycles. This method tends to exercise the buttocks and thigh muscles.

The preferred embodiments of the invention described herein are exemplary and numerous modifications, dimensional variations and rearrangements can be readily envisioned to achieve an equivalent result, all of which are intended to be embraced within the scope of the appended claims.

I claim:

1. A method for exercising buttocks and thigh muscles, comprising the steps of:

providing a base having a floor abutting member;

providing a body contact member having a defined periphery;

pivotably supporting the body contact member a selected height above the base at one portion of its periphery for vertical pivoting up and down;

yieldingly supporting said contact member between vertically spaced first and second positions thereof in response to said vertical pivoting with a biasing member disposed between said contact member and said base;

lying face-up with said contact member under the buttocks and the knees bent; and urging, with said buttocks and thigh muscles, said contact member between said first and second positions.

* * * * *

UNITED STATES PATENT AND TRADEMARK OFFICE

CERTIFICATE OF CORRECTION

PATENT NO. : 5,352,173

DATED : October 4, 1994

INVENTOR(S) : Gary McLaughlin

It is certified that error appears in the above-indentified patent and that said Letters Patent is hereby corrected as shown below:

Column 1, line 61 and 62, change to read —FIG. 2 is an isometric view of the apparatus of FIG. 1.—

Column 2, line 47, change "54b" to —56b—.

Column 3, line 22, change "bolt" to —eye bolt—.

Signed and Sealed this

Twenty-fifth Day of April, 1995

*Attest:*

Bruce Lehman

BRUCE LEHMAN

*Attesting Officer*

*Commissioner of Patents and Trademarks*